US008939308B2

(12) United States Patent
Ramsey et al.

(10) Patent No.: US 8,939,308 B2
(45) Date of Patent: Jan. 27, 2015

(54) FULL APERTURE BEVERAGE END

(75) Inventors: Christopher Paul Ramsey, Wantage (GB); Garry Richard Chant, Wantage (GB); Andrew Robert Lockley, Wantage (GB); Brian Fields, Lemont, IL (US); Martin John Watson, Wantage (GB); Eleanor Rachel Ann Hyde, Wantage (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 12/797,171

(22) Filed: Jun. 9, 2010

(65) Prior Publication Data

US 2011/0056945 A1 Mar. 10, 2011

(30) Foreign Application Priority Data

Sep. 4, 2009 (EP) ..... 09169559

(51) Int. Cl.

| | |
|---|---|
| ***B65D 17/353*** | (2006.01) |
| ***B65D 17/347*** | (2006.01) |
| ***B65D 17/34*** | (2006.01) |
| ***B65D 17/00*** | (2006.01) |

(52) U.S. Cl.

CPC ..... *B65D 17/163* (2013.01); *B65D 17/24* (2013.01)

USPC ..... 220/273; 220/269; 220/270

(58) Field of Classification Search

USPC ..... 206/269, 273, 270, 276, 266, 619, 620

See application file for complete search history.

(56) References Cited

U.S. PATENT DOCUMENTS

| | | | | |
|---|---|---|---|---|
| D30,094 | S | 1/1899 | Busch | |
| D30,338 | S | 3/1899 | Mann | |
| 2,683,579 | A | 7/1954 | Wallace | |
| 3,301,464 | A | 1/1967 | Amberg | |
| 3,406,866 | A * | 10/1968 | Jasper | 220/270 |
| 3,477,608 | A | 11/1969 | Fraze | |
| 3,485,410 | A | 12/1969 | Boik | |
| 3,951,299 | A | 4/1976 | Khoury | |
| 4,002,262 | A | 1/1977 | Khoury | |
| 4,096,967 | A | 6/1978 | Kaminski | |
| 4,182,460 | A | 1/1980 | Holk, Jr. et al. | |

(Continued)

FOREIGN PATENT DOCUMENTS

| | | |
|---|---|---|
| CH | 527102 | 8/1972 |
| EP | 0737624 | 10/1996 |

(Continued)

OTHER PUBLICATIONS

U.S. Appl. No. 29/368,323: Notice of Allowance dated Dec. 3, 2010, 6 pages.

(Continued)

*Primary Examiner* — Andrew Perreault
(74) *Attorney, Agent, or Firm* — Baker & Hostetler LLP

(57) ABSTRACT

A full aperture beverage end has a center panel, a countersink surrounding the center panel, a main score arranged in proximity to the countersink to define a removable aperture panel and a vent score. The beverage end is adapted for use with products that are pressurized to over 30 psi (200 kPa) when opened, and during opening the vent score is adapted to sever first, controlling the pressure differential between the external surface and internal surface of the center panel, thereby allowing the main score to tear in a controlled and reliable manner.

22 Claims, 12 Drawing Sheets

(56) References Cited

U.S. PATENT DOCUMENTS

| | | | | | |
|---|---|---|---|---|---|
| RE30,349 | E | | 7/1980 | Silver | |
| 4,271,778 | A | | 6/1981 | Le Bret | |
| D265,280 | S | | 7/1982 | Conti | |
| D286,508 | S | | 11/1986 | Tilden | |
| 4,809,861 | A | | 3/1989 | Wilkinson et al. | |
| 5,052,573 | A | * | 10/1991 | Zysset | 220/271 |
| D328,864 | S | | 8/1992 | Grunzweig | |
| 5,232,114 | A | | 8/1993 | Zysset | |
| 5,356,256 | A | | 10/1994 | Turner et al. | |
| D356,456 | S | | 3/1995 | Henry | |
| D358,988 | S | | 6/1995 | Nolte | |
| 5,582,319 | A | | 12/1996 | Heyes et al. | |
| D379,588 | S | | 6/1997 | Pledger et al. | |
| 5,711,448 | A | | 1/1998 | Clarke, III | |
| 5,860,553 | A | | 1/1999 | Shubert | |
| D406,236 | S | | 3/1999 | Brifcani et al. | |
| 5,911,551 | A | | 6/1999 | Maran | |
| 5,934,498 | A | * | 8/1999 | Jordan | 220/270 |
| 5,957,647 | A | | 9/1999 | Hinton | |
| 5,971,259 | A | | 10/1999 | Bacon | |
| 6,065,634 | A | | 5/2000 | Brifcani et al. | |
| 6,089,072 | A | | 7/2000 | Fields | |
| D431,413 | S | | 10/2000 | Schaper et al. | |
| D480,304 | S | | 10/2003 | Stodd | |
| D488,376 | S | | 4/2004 | Chung | |
| 6,848,875 | B2 | | 2/2005 | Brifcani et al. | |
| 6,915,553 | B2 | | 7/2005 | Turner et al. | |
| D515,353 | S | | 2/2006 | Martin | |
| D525,127 | S | | 7/2006 | Cogley et al. | |
| 7,100,789 | B2 | | 9/2006 | Nguyen et al. | |
| D559,680 | S | | 1/2008 | Jacober et al. | |
| 7,341,163 | B2 | | 3/2008 | Stodd | |
| D567,657 | S | | 4/2008 | Hall et al. | |
| D570,213 | S | | 6/2008 | Newman | |
| 7,500,376 | B2 | | 3/2009 | Bathurst et al. | |
| 7,506,779 | B2 | | 3/2009 | Jentzsch et al. | |
| D591,149 | S | | 4/2009 | Bonner et al. | |
| 7,673,768 | B2 | | 3/2010 | Reed et al. | |
| 7,743,635 | B2 | | 6/2010 | Jentzsch et al. | |
| 7,922,025 | B2 | * | 4/2011 | Heinicke | 220/273 |
| 2004/0026433 | A1 | | 2/2004 | Brifcani et al. | |
| 2005/0284869 | A1 | | 12/2005 | Mills | |
| 2007/0029324 | A1 | * | 2/2007 | Watson et al. | 220/269 |
| 2008/0067171 | A1 | | 3/2008 | Heinicke | |
| 2010/0059530 | A1 | * | 3/2010 | Niec et al. | 220/623 |

FOREIGN PATENT DOCUMENTS

| | | |
|---|---|---|
| EP | 1577222 | 9/2005 |
| EP | 1813540 | 8/2007 |
| EP | 2070826 | 6/2009 |
| EP | 09169559.3 | 9/2009 |
| GB | 1358427 | 7/1974 |
| GB | 1453131 | 10/1976 |
| GB | 2168313 | 6/1986 |
| JP | 47-22064 | 11/1972 |
| JP | S58-109922 | 7/1983 |
| JP | 59-133439 | 9/1984 |
| JP | S59-209533 | 11/1984 |
| JP | 2000-128168 | 5/2000 |
| WO | WO 03/068615 | 8/2003 |
| WO | WO 2009/002715 | 12/2008 |
| WO | WO 2010/020375 | 2/2010 |

OTHER PUBLICATIONS

U.S. Appl. No. 29/363,498: Notice of Allowance dated Nov. 29, 2010, 6 pages.

U.S. Appl. No. 29/363,492: Notice of Allowance dated Nov. 30, 2010, 7 pages.

U.S. Appl. No. 29/363,500: Notice of Allowance dated Nov. 30, 2010, 6 pages.

Ball Packaging Europe, "Full aperture tear-off end", http://www.ball-europe.com/382_349_ENG_PHP.html, accessed Dec. 2, 2010, 1 page.

"Nuts About Cans!", Rexam PLC, Beverage Packaging: Product News, Apr. 7, 2005, 2 pages.

English translation of Japanese Patent Application No. 2012-527320: Notification of Reason for Rejection dated Apr. 2, 2014, 3 pages.

* cited by examiner

FULL APERTURE BEVERAGE END

CROSS-REFERENCE TO RELATED APPLICATION TECHNICAL FIELD

This application claims priority to European Patent Application EP09169559.3, filed Sep. 4, 2009, the contents of which are incorporated herein by reference in its entirety.

TECHNICAL FIELD

The present invention relates generally to beverage cans and particularly to the size of the drinking aperture created in a beverage can end.

BACKGROUND

Conventional full aperture can ends include a score that extends about the major area of the end's center panel and defines a removable panel. A tab is attached to the removable panel by a rivet. The tab heel is lifted initially to rupture the score, and then the tab is pulled to propagate the score until the removable panel is fully detached from the remainder of the end. Typically, full aperture opening ends are seamed onto food can bodies by conventional means.

Full aperture food can ends are also typically designed to allow full product release of the foodstuff contained within the food can. Often, this foodstuff is packed under slight negative pressure. In applications in which the food can is under positive internal pressure, the internal pressures are relatively low and because the pressure's primary purpose is to maintain the structural rigidity of the food can, which is often relatively "thin-walled".

The internal pressure in conventional beverage cans, such as for carbonated soft drinks or beer, typically is much higher than the internal pressures in food cans, resulting in concerns related to "blow-off" of the ends upon opening or when subjected to adverse handling. For these reasons, commercial beverage cans have ends defining a restricted aperture, which can be safely opened by a consumer.

U.S. Pat. No. 5,711,448, assigned to Reynolds Metals Company, describes a conventional "large opening end" (that is, and end having a large opening). The patent describes "standard size opening" of 0.5 square inches and a "larger opening" of 0.5 to 0.75 square inches, each of which represents a relatively small fraction of the center panel.

Full aperture beverage can ends have been sold in the past but had safety problems and have been withdrawn from the market. 'Spiral scored' ends were produced for Sapporo beer, where the can end was vented in its centre and then the score propagated to the edge of the can end panel and the around the periphery thereof. Venting was critical because the end was relatively large, 66 mm diameter with a 52 mm centre panel size. If the end was opened without being vented, the panel could explode and missile towards the consumer. Thus a vent was used to provide safe venting and release the internal pressure in the can before opening. However the resulting spiral geometry of the opened end panel was dangerous having several long exposed cut edges and for this reason, this can end configuration was withdrawn.

SUMMARY OF INVENTION

The present invention relates to a full aperture beverage can end that has a center panel and a countersink that surrounds the center panel. The can end further comprises a main score arranged in proximity to the countersink to define a removable aperture panel as well as a vent score. The can end is adapted for use with products that are pressurized to over 30 psi (200 kPa). During opening, the vent score is configured to sever before the main score. In this way, the pressure differential between the external surface and internal surface of the center panel reaches equilibrium gradually. This allows the main score to tear in a controlled and reliable manner.

The present invention may further comprise a tab attached to the center panel by a rivet. The tab functions to assist the user in opening the can end. Additionally the main score may have an outer wall proximate a lip of the end, an inner wall proximate the aperture panel, and a land at the base of the main score. The land has a thickness that is smaller proximate the main score outer wall than the land thickness proximate the main score inner wall. This configuration allows the land to remain affixed to the aperture panel after detachment of the aperture panel.

According to another aspect of the present invention, a full aperture beverage can having rated for internal pressure of over 30 psi (200 kPa) includes a can body and a can end. The can end includes a center panel, a countersink surrounding the center panel, a tab attached to the center panel by a rivet, a main score that defines a removable aperture panel, and a vent score formed in the aperture panel. The main score has an outer wall proximate a lip of the end, an inner wall proximate the aperture panel, and a land at the base of the main score. The land has a thickness that is smaller proximate the main score outer wall than the land thickness proximate the main score inner wall. Accordingly, the land remains affixed to the aperture panel after detachment of the aperture panel.

The can may also be rated for internal pressures of at least 70 psi, 85 psi, or 90 psi. Preferably, the centerline of the main score is located between 0.000 and 0.020 inches, more preferably between 0.000 inches and 0.010 inches, more preferably between 0.000 inches and 0.006 inches, more preferably between 0.000 inches and 0.004, and most preferably between 0.000 inches and 0.002 inches, from a center of a transition radius between the countersink and the center panel.

A nose of the tab in its rest state is radially inwardly spaced apart from an inner edge of the main score by between approximately 0.000 inches and 0.008 inches, more preferably between approximately 0.000 inches and 0.005 inches, measured horizontally. In its partially actuated state, in which the tab nose contacts the center panel, the nose of the tab is approximately between the centerline of the main score and 0.005 inches radially inboard from an inner edge of the main score—more preferably within 0.002 inches of an inner edge of the main score.

Among the benefits for consumers are that because the beverage can becomes more like a drinking glass, consumers can drink from the can from any orientation and the can contents can be sipped rather than poured into the mouth. Furthermore, the content of the can is visible after opening, showing the colour, level of carbonation, and head (with widgeted beers).

One of the benefits for fillers is that the cans may be sold at festivals and events, as they can no longer be used as missiles. The larger, full aperture ensures that once opened, the majority of the beverage does not remain in the can is thrown. Furthermore, sealed beverage cans are preferable to glasses as they can be freshly opened immediately upon serving and thus many drinks can be freshly served in the interval periods during events.

BRIEF DESCRIPTION OF DRAWINGS

The present invention will now be described, by way of example only, with reference to the accompanying drawings, in which.

DESCRIPTION OF EMBODIMENTS

A can assembly 10 includes a one-piece can body 12 and a can end 14 that are joined together at a seam 16. Preferably, can body 12 and seam 16 are conventional according to commercial carbonated beverage standards.

Figure 1:
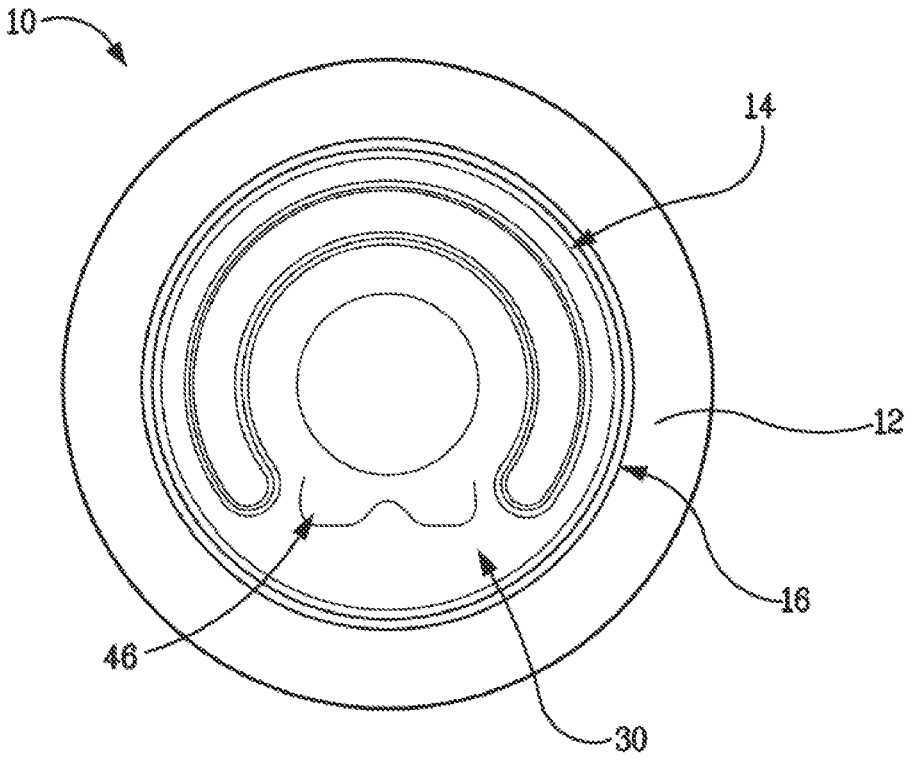
FIG. 1 shows a plan view of can having a beverage end (tab not shown) according to a first embodiment of the present invention.

FIG. 1 illustrates a first embodiment end 14 with the tab omitted for clarity. End 14, preferably formed of 5000 series aluminum, includes an wall portion 20, a countersink 22, and a center panel 30. The shell configuration (that is, the end without the tab, having the structure as it leaves the shell press) has a configuration, including wall 20, countersink 22, and center panel 30, in the embodiment shown in FIG. 1, that preferably is a conventional SuperEnd® end as supplied by Crown Cork & Seal in a commercially popular size, such as 202, 204, or 206.

Figure 8:
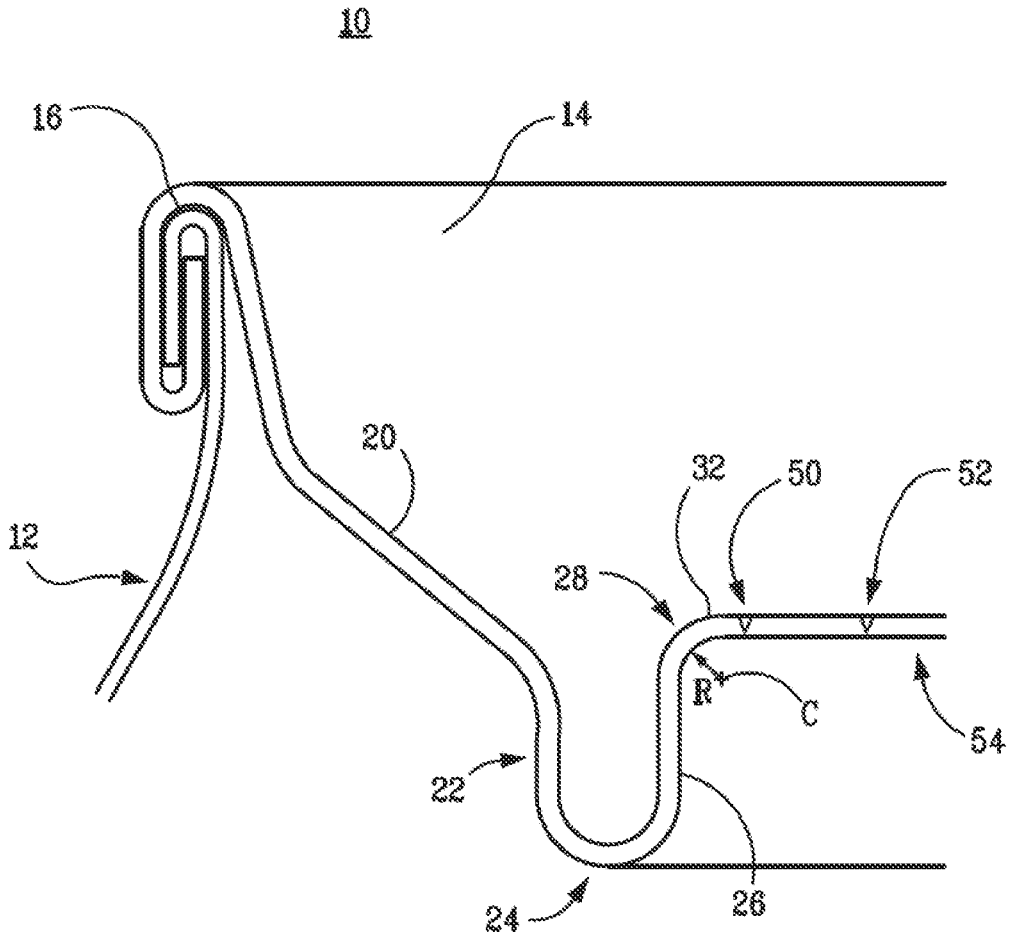
FIG. 8 is a cross section view of a portion of the can end according to the invention fixed to a can body.

Countersink 22 extends from the lower part of wall 20 and includes a curved bottom portion 24 and an inner wall 26 that extends up from bottom 24. Inner wall 26, in the first embodiment (FIG. 1) has a straight portion that merges into center panel 30 via transition 28 having a radius R. The origin of radius R is point C, as best shown in FIG. 8. For embodiments having a curved transition that does not have a single radius and a single origin, averages may be used.

Center panel 30 includes a rivet 34, a moustache score 46, a main score 50, and an anti-fracture score 52. Rivet 34 preferably is conventional. A tab 36 is attached to center panel 30 by rivet 34. Tab 36 preferably is a solid tab—that is, without an integral hinge. Center panel 30 preferably is approximately planar in its unseamed or unpressurized state.

Moustache score 46 is configured to enable venting of pressurized can assembly 10. For internal pressures greater than 30 psi, the vent score described in co-pending U.S. patent application Ser. No. 12/796,072, the disclosure of which is incorporated herein by reference, is preferred. As tab 36 is lifted by its handle or heel 38, moustache score 46 is designed to break before main score 50 to vent the internal pressure in can 10.

Main score 50 extends about the periphery of center panel 30 and defines a removable aperture panel 54. As shown in the Figures, tab 36 is attached to aperture panel 54. As is conventional, anti-fracture score 52 is also located on aperture panel 54 radially inside of main score 50 to reduce stress and take up slack metal. Upon removal of aperture panel 54, a lip 32 is left behind. Lip 32 is the portion of end 14 that extends radially inwardly from the inside edge of the seam 16. Further, aperture panel 54 may include debosses and embosses, as explained more fully below.

The inventors have identified the importance of configuring end 14 in such a way that main score 50 is in a location on end 14 that is sufficiently stiff to promote initial rupture of score 50 upon initial actuation of tab 36. FIG. 8 is an enlarged view of a first embodiment of end 14 and illustrates the relationship between main score 50 and countersink 22, which stiffens end 14 in the region of end 14.

Preferably, the centerline of main score 50 is near countersink 22 at the location of contact between tab nose 40 and center panel 30 such that the structural stiffness of countersink 22 prevents excessive panel deflection to promote initial score fracture. For example, the horizontal distance between transition curve origin C and the vertical center of main score 50 may be as low as 0.000 inches (that is, falling on the same vertical axis). Preferably, the centerline of main score 50 does not extend radially outside of point C so that the main score does not interfere with the structural performance of countersink 22. In the embodiment of FIG. 1, the centerline of main score 50 preferably is within approximately 0.020 inches, more preferably is within approximately 0.010 inches, more preferably approximately 0.0060 inches, more preferably approximately 0.004 inches, and even more preferably approximately 0.002 inches (measured horizontally) of point C to get the benefit of countersink stiffening. The upper limit of distance between the main score centerline and point C may also be determined by aesthetics or the functional aspects of drinking. Alternatively, main score 50 may be spaced apart from countersink 22 and preferably located near a structural stiffener, such as an emboss, deboss, or like ridge. The configuration and distance of the main score and countersink may be chosen according to parameters that will be understood by persons familiar with beverage can end engineering and design upon considering this specification.

Figure 7A:
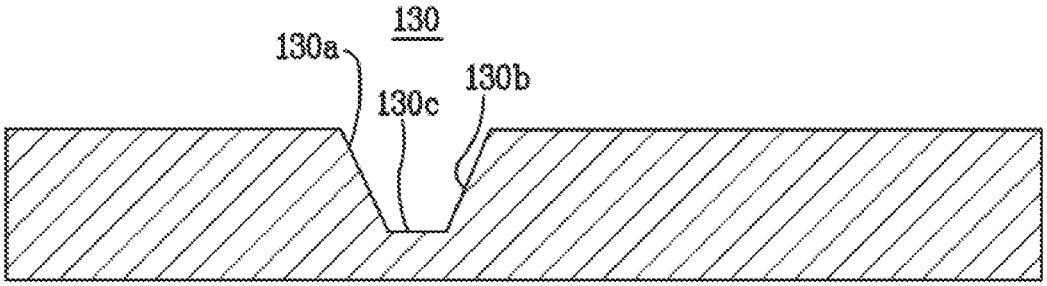
PRIOR ART FIG. 7A
FIG. 7A (Prior Art) is a cross sectional sketch showing a standard (symmetrical) score profile used on conventional beverage ends.

FIG. 7A illustrates a symmetrical score profile 130 currently used for the aperture score of conventional beverage ends. Symmetric score 130 has a generally trapezoidal shape that includes a pair of identical but oppositely oriented sidewalls 130*a* and 130*b* and a generally flat land 130*c*. In practice, it is difficult to control or predict exactly where (in its cross section) score 130 severs. Land 130*c*, when severed and extending at the base of either sidewall 130*a* or 130*b*, makes the edge sharp. This edge is more likely to cut a user than the fillet. The fillet is the score sidewall from which land the score residual of land 130*c* breaks cleanly (that is, the part of the score sidewall to which no portion or an insignificant part of the score residual of land 130*c* remains attached).

Figure 7B:
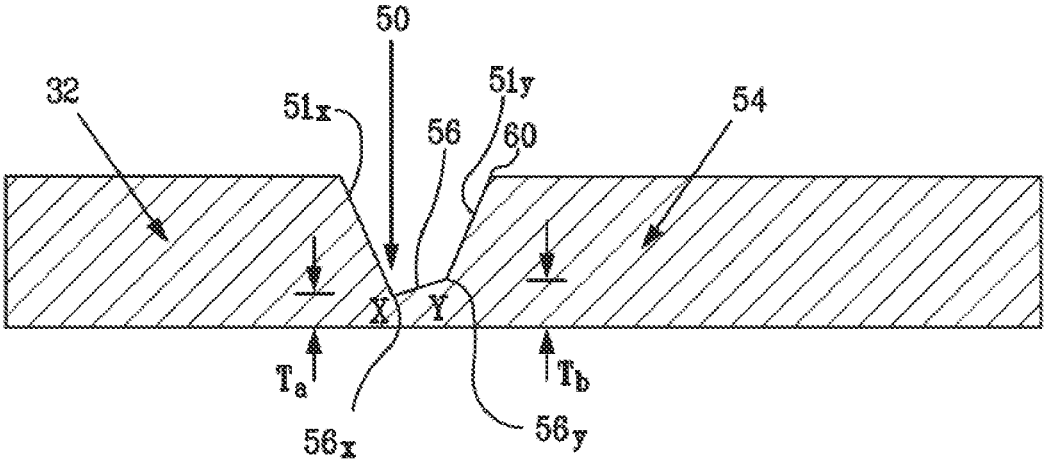
FIG. 7B is a cross sectional sketch showing the (asymmetric) score profile used for the main score on ends according to the invention.

FIG. 7B illustrates the asymmetrical main score 50 used on the beverage end 14 according to an aspect of the present invention. Asymmetric main score 50 has a pair of sidewalls 51*x* and 51*y* that extend to two different depths X and Y relative to the top surface of center panel 30. Main score 50 also has a land 56. In this specification, the term "land" refers generally to top surface or width and the term "score residual" refers to the thickness. Ends of the land 56*x* and 56*y* (in cross section as shown in FIG. 7B) are defined as the points at which the land merges into or transitions into the score sidewalls 51*x* and 51*y*. In its opened state, the thickness at land ends 56*x* and 56*y* have score residual thicknesses $T_a$ and $T_b$.

Thicknesses T-a and T-b may be chosen according to the desired parameters of end 14, such as proximity of score 50 to countersink 22, end thickness and material, desired pressure rating, tab configuration, and the like. For the embodiment shown in FIG. 1, the thickness of center panel 30 is between 0.0075 inches and 0.013 inches, the width of score 50 at its top is approximately 0.007 inches, the width of score land 56 is approximately between 0.001 inches and 0.003 inches. T-a is approximately between 0.002 inches and 0.004 inches and T-b is approximately between 0.0025 inches and 0.045 inches. The present invention is not limited to the particular dimensions provided in this specification unless expressly stated in the claims. Rather, the invention encompasses other dimensions in accordance with the broad disclosure of its inventive aspects.

The score residual at thinner end 56*x* of score land 56 tends to fracture more readily than that at thicker end 56*y*. This tendency is an advantage in controlling the location of the fracture within main score 50. In this regard, the cross sectional structure of score 50 is configured such that the score residual of land 130*c* remains attached to aperture panel 54 rather than to lip 32 (that is, because the score residual at land outer end 56*x* is thinner than that at land inner end 56*y*), therefore leaving lip 32 having a fillet configuration.

The inventors have found also that for a given score, the structure and operation of the tab affects the reliability and predictability of the main score fracture. In this regard, if tab nose 40 is too far from main score 50, end 14 may fracture between main score 50 and anti-fracture score 52 or within anti-fracture score 52, rather than solely in main score 50. Measured upon actuation of tab 36 when tab nose 40 first contacts end 14 and before main score fracture, tab nose 40 preferably does not span across main score 50 to touch the outer score wall 51*x*. Preferably, tab nose 40, upon contact with end 14, is at the centerline of main score 50 or on aperture panel 54 within 0.005 inches radially inboard of the inner edge 60 of main score 50 (FIG. 7B). More preferably, tab nose 40 is within 0.002 inches on either side of the inner edge 60.

Figure 9:
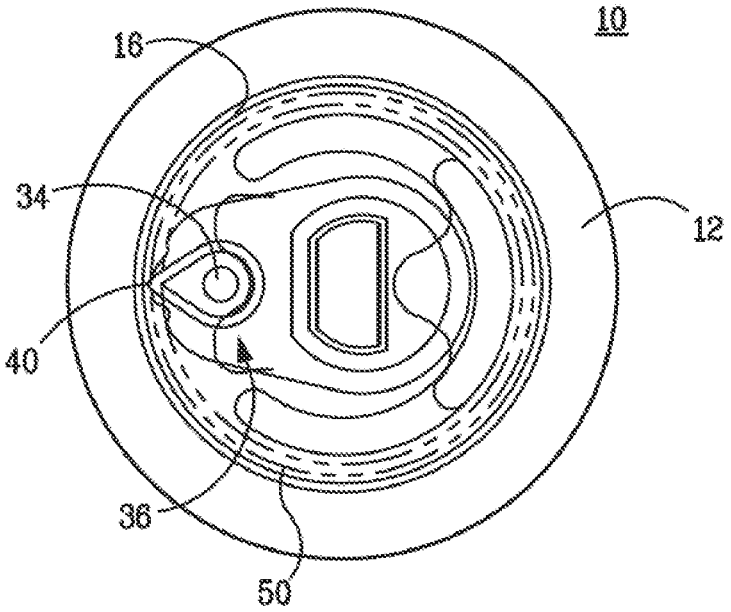
FIG. 9 is a top view of the can shown in FIG. 2.

The location of tab nose 40 may also be measured with the tab in its at-rest state before actuation by a user. In this regard, tab nose 40 preferably is between approximately 0.000 inches and 0.008 inches from the inner edge 60 of main score 50, and more preferably between 0.000 inches and 0.005 inches, as measured radially inwardly from edge 62. The difference in location of tab nose 40 relative to main score 50 between its initial contact state and its at-rest state is to account for shunting during the tab actuation process. Tab 36 shunts forward in the end shown in FIG. 1 during the actuation and opening process by about 0.003 inches mostly because of deflection of panel 30 near rivet 34 and opening of vent score 46. The magnitude of tab nose shunting also depends on internal can pressure. In general, higher pressure creates shunting of a corresponding greater magnitude. For simplicity, the dimensions provided for tab nose location relative to main score 50 are measured with a microscope looking straight down on end 14, as shown for example in FIG. 9.

The location of tab nose 40 relative to main score 50 may be chosen according to the design parameters of the particular end, such as main score configuration, tab design, vent score design, can internal pressure, and other factors that will be understood by persons familiar with can end engineering and design upon considering the present specification.

Figure 2:
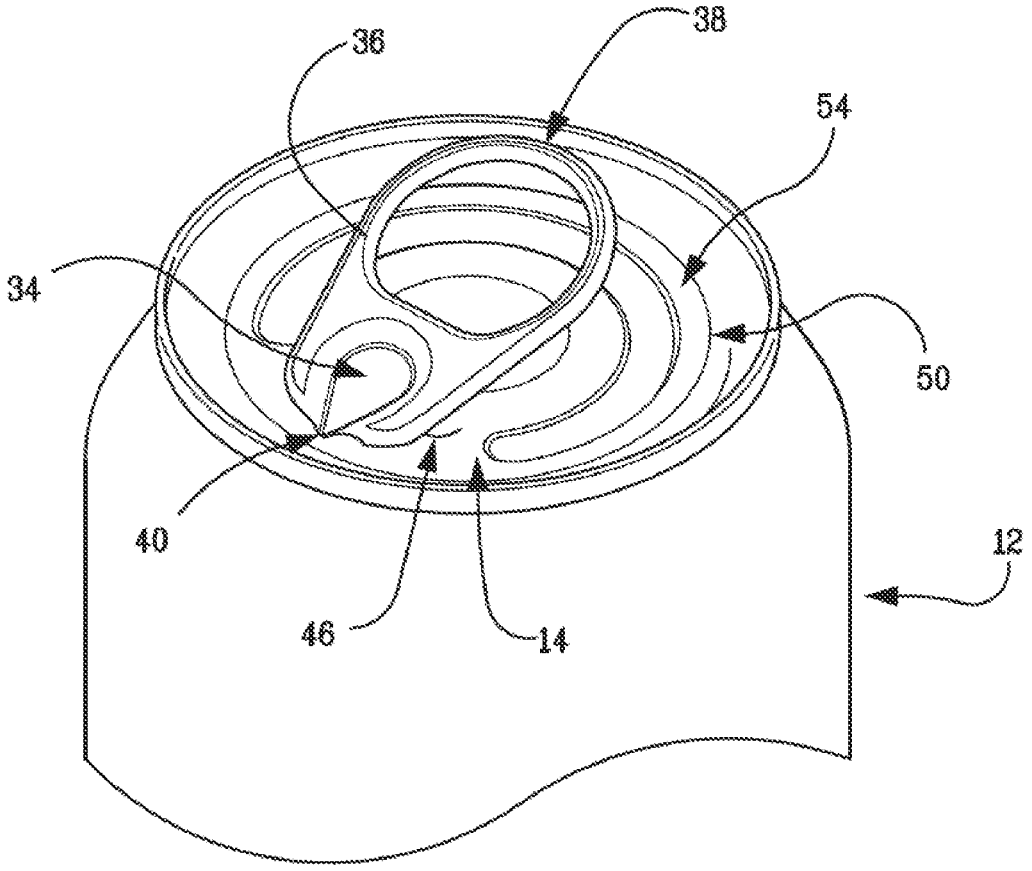
FIG. 2 shows a 3-dimensional view of a container incorporating the beverage end according to the invention, including a tab in a vented position (after the vent score has been severed)
Figure 3:
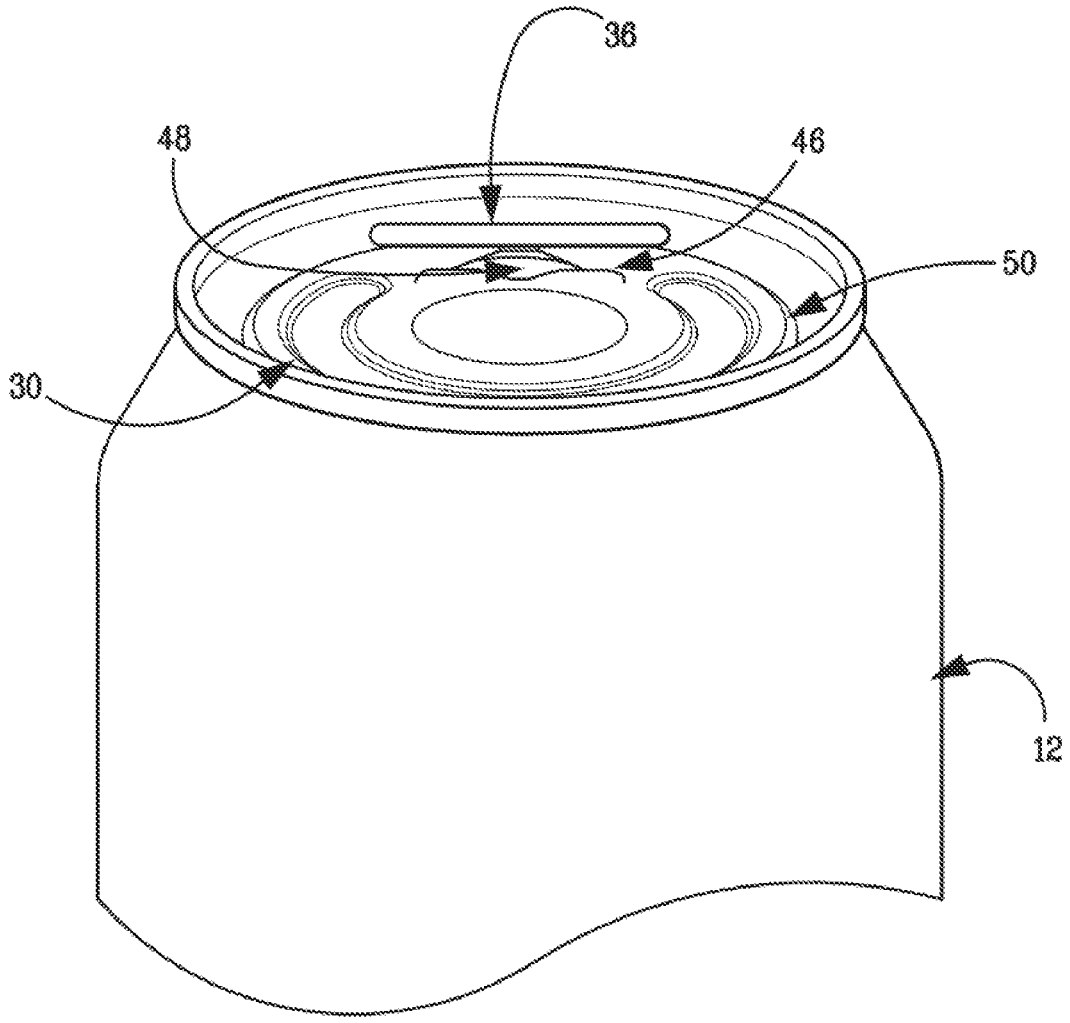
FIG. 3 shows a 3-dimensional view of the container and beverage end shown in FIG. 2, from a rear angle.

FIGS. 2 through 6 show different 3-dimensional views of the first embodiment beverage end 14 applied to a filled can 10 (product level not shown). FIGS. 2 and 3 illustrate the operation of end 14. A user first lifts heel 38 of tab 36, which pivots around the rivet 34. The force and moment applied to rivet 34, and the corresponding local deflection of center panel 30, severs the vent score 46 creating a vent hole 48 (see FIG. 3). Preferably, vent score 46 is in the form of a flap such that internal pressure of the can causes the fracture of vent score 46 to rupture without arresting, thereby deflecting the flap to vent pressures of greater than 30 psi, such as 70 psi, 85 psi, and 90 psi and above.

Figure 11:
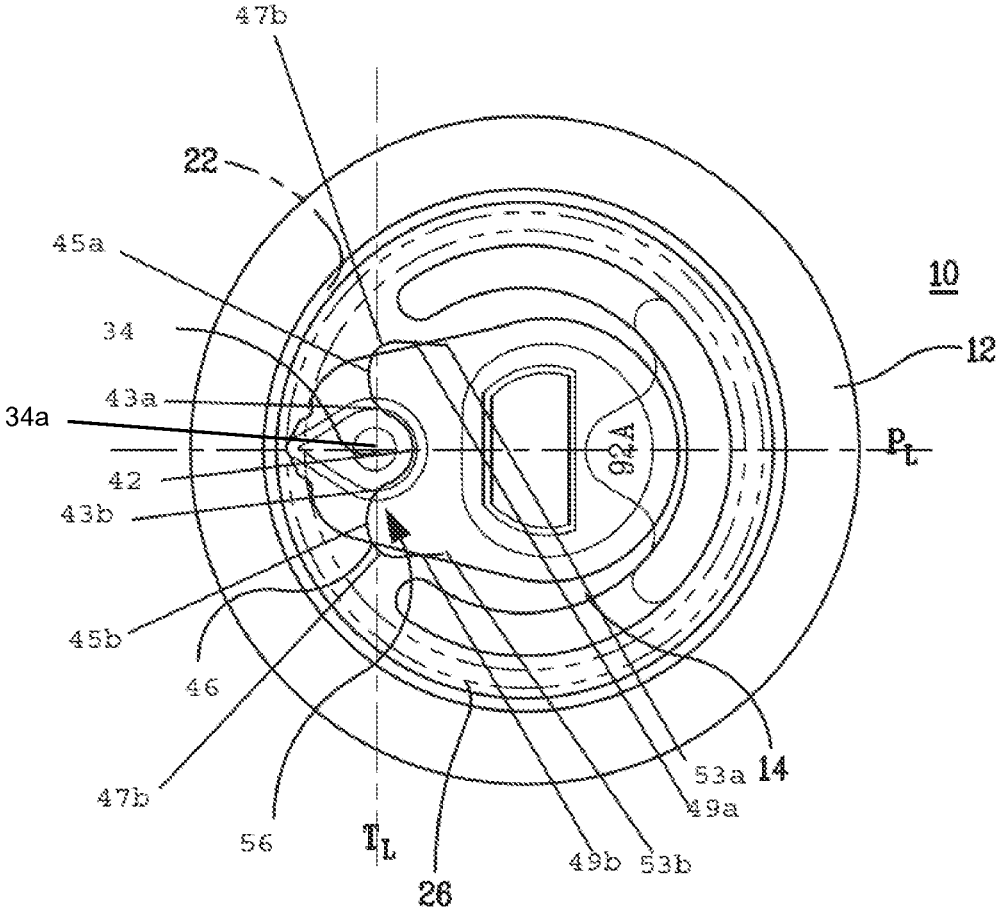
FIG. 11 is a top view of the can of FIG. 2, with the tab shown as transparent to illustrate the vent score.
Figure 12:
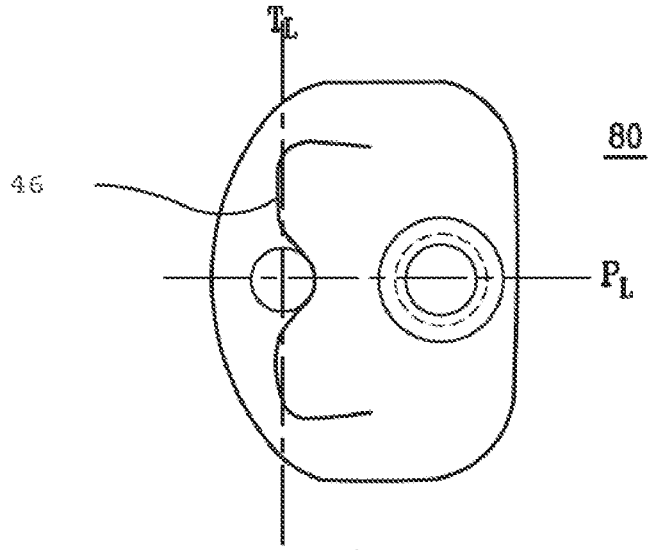
FIG. 12 is a top view of a punch for forming the vent score shown in FIG. 1.
Figure 13:
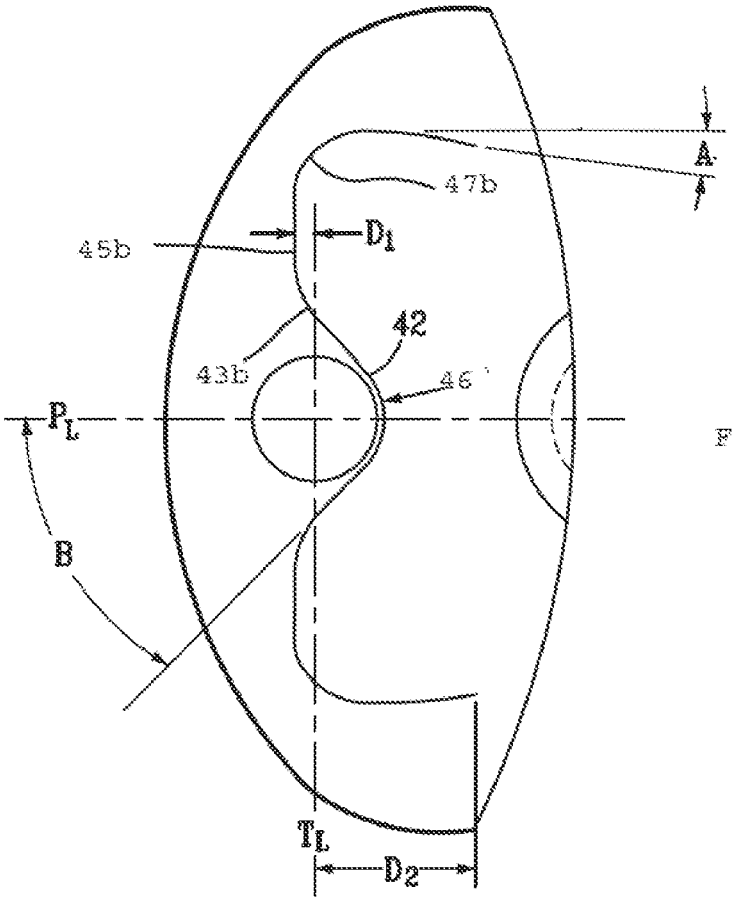
FIG. 13 is an enlarged view of a portion of the punch of FIG. 11.

FIGS. 11-13 illustrate the components of the end 14. To aid in the description of center panel 30, primary or center reference line $P_L$ is defined as extending through the center 34*a* of rivet 34 and through the longitudinal centerline of tab 36. For the vast majority of commercial tabs, primary reference line $P_L$ will extend through the point of initial contact between the nose of tab 36 and its point of initial contact on the center panel. Transverse reference line $T_L$ is defined as extending through the center of rivet 34 and perpendicular to the primary reference line $P_L$. The plane defined by lines $P_L$ and $T_L$ is parallel to the plane defined by the top of the seam and parallel to center panel 30, to the extent that center panel 30 defines a plane in its seamed or unseamed state. Primary reference line $P_L$ divides can end 14 into a front portion on the side of the tab nose and a rear portion on the side of the tab heel.

Figure 5:
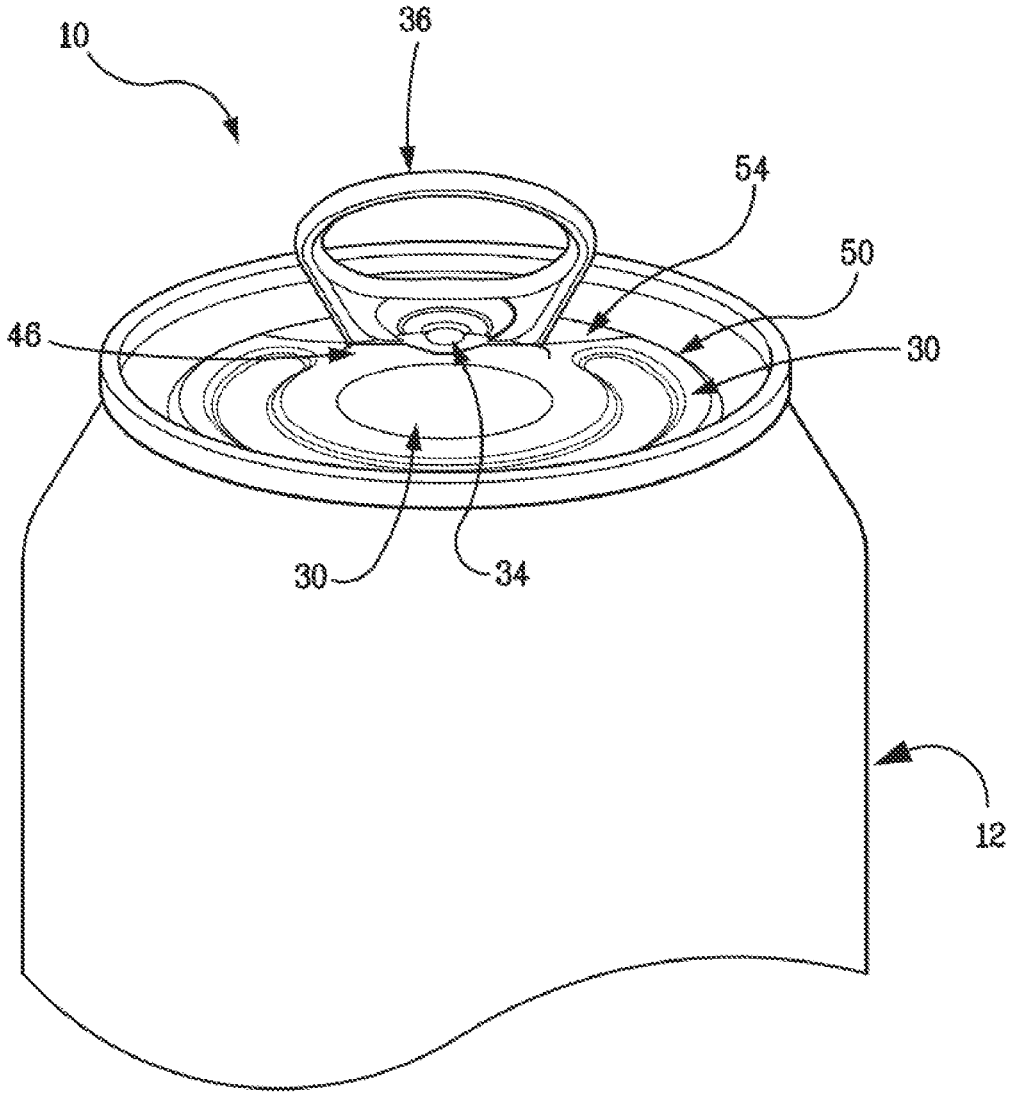
FIG. 5 shows a 3-dimensional view of the container and beverage end shown in FIGS. 2 and 3 (from the same angle as shown in FIG. 3) after the vent score has been broken and as the main score starts to sever.
Figure 6:
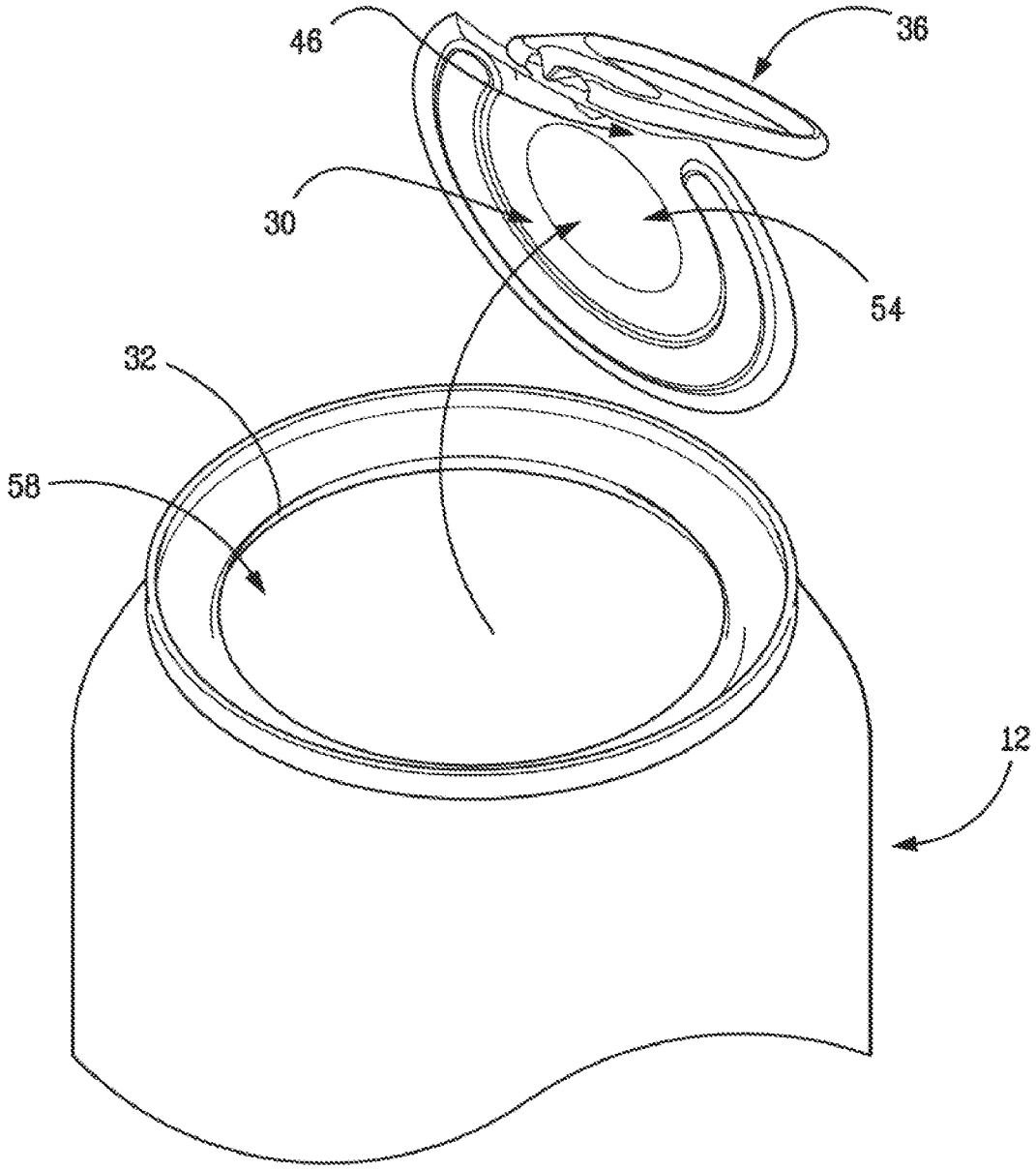
FIG. 6 shows a 3-dimensional view of the container and beverage end after the main score has completely severed allowing the aperture to be exposed and the aperture panel to be removed.

Vent score 46 includes a central portion 42, a pair or lateral portions 45*a* and 45*b*, and a pair of side portions 49*a* and 49*b*. As best shown in FIG. 5, central portion 42 of vent score 46 is rounded as it extends around the rear center portion of rivet 34. Opposing ends of central portion 42 extend forward about the rivet toward transverse reference line $T_L$. Ends of central portion 42 yield to corresponding inner ends of lateral portions 45*a* and 45*b* through transitions 43*a* and 43*b*, which preferably are approximately straight and angled from primary reference line $P_L$ by an angle B that is approximately 45 degrees. Lateral portions 45*a* and 45*b* extend generally laterally (that is, generally parallel to transverse reference line $T_L$) and outwardly relative to rivet 34. Side portions 49*a* and 49*b* extend generally rearward from outer ends of lateral portions 45*a* and 45*b* through transitions 47*a* and 47*b*. Side portions 49*a* and 49*b* end at terminations 53*a* and 53*b*. The vent score terminations may be curved, curled, or angled relative to the side portions of the vent score, or they may simply be the ends of straight side walls, as shown in the figures.

Dimensional information of vent score 46 is provided with reference to the enlarged view of the tool 80 for forming the vent score in FIG. 13. Preferably, a portion of vent score 46 extends to (or approximately to) or forward of the transverse reference line $T_L$ to promote movement or hinging of the tab and rivet. For example, lateral portions 45*a* and 45*b* preferably extend forward of transverse line $T_L$ by a dimension $D_1$. Preferably, $D_1$ is positive and between 0 and 0.050 inches, and more preferably between 0.010 inches and 0.032 inches. In the embodiment shown in the figures, $D_1$ is approximately 0.021 inches.

Side portions 49*a* and 49*b* are mutually spaced apart and extend rearwardly such that flap 57 creates sufficient area for venting. The vent hole is shown in FIG. 3 as reference numeral 48. In this regard, side portions 49*a* and 49*b* preferably extend rearwardly from transverse reference line $T_L$ by a distance $D_2$ that preferably is between 0.15 and 0.4 inches, and more preferably is between 0.2 and 0.3 inches. In the embodiment shown in the figures, $D_2$ is 0.238 inches. The ends of side portion terminations 53*a* and 53*b* are spaced apart by a distance of between 0.5 inches and 1.0 inches and preferably between 0.6 and 0.8 inches. In the embodiment shown, the distance between 53*a* and 53*b* is 0.742 inches.

Vent score sides may be curved or straight, and oriented at any angle A, measured relative to primary reference line $P_L$. For example, A may be approximately zero (that is, the vent score sides may be approximately parallel to primary reference line P-L), between +/−10 degrees, between +/−20 degrees, or between +/−30 degrees. In the embodiment shown in the figures, angle A is 5 degrees. Central portion 42 and lateral portions 45*a* and 45*b* may be shapes other than as shown in the figures.

Figure 4:
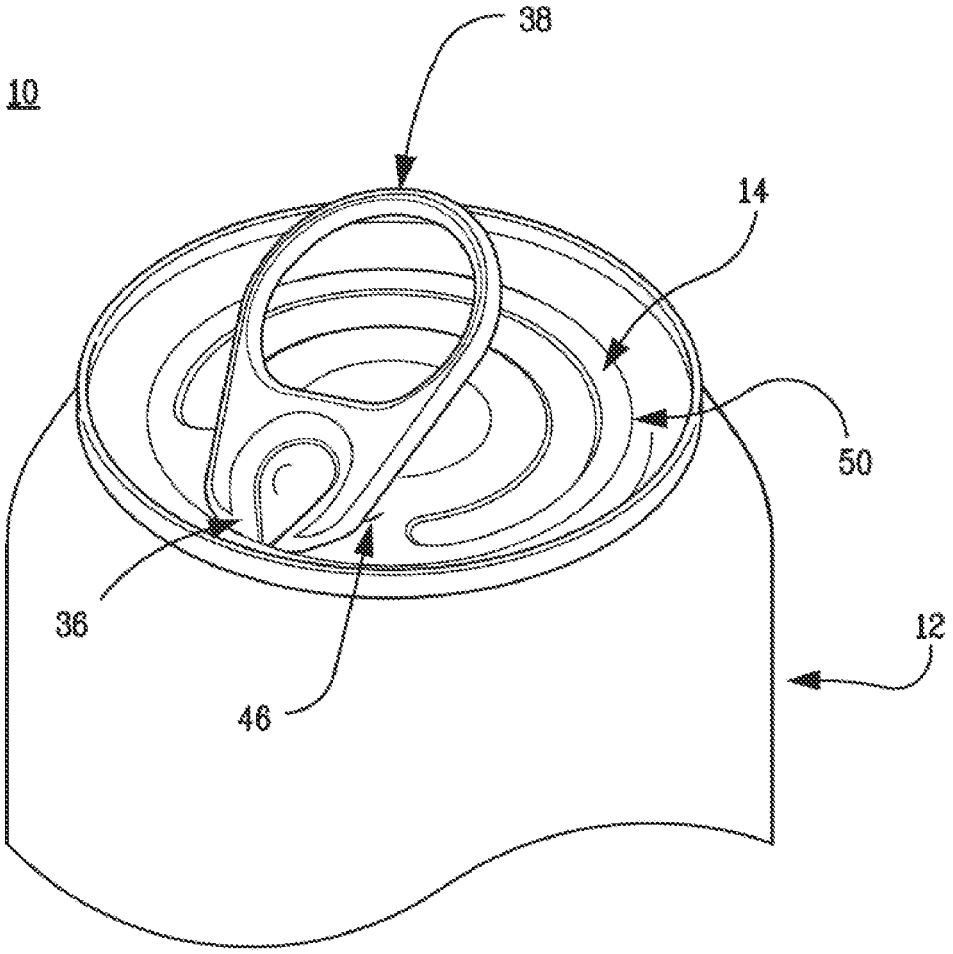
FIG. 4 shows a 3-dimensional view of the container and beverage end shown in FIGS. 2 and 3 (from the same angle as shown in FIG. 2) after the vent score has been broken and as the main score starts to sever.

As illustrated in FIGS. 4 and 5, the user then continues to lift the tab 36, which causes the tab nose 40 to press on the center panel 30 close to the main score 50, as described above. Tab nose 40 severs main score 50 at land outer end 56*x*. The user then pulls up on the tab 36 to break the remainder of the main score 50. Preferably, the fracture propagates around aperture panel 54 at land outer end 56*x* such that the score residual of land 56 is attached to aperture panel 54. Lip 32 remains part of the can assembly 10 and ideally has the cross sectional structure of a fillet (that is, a cross-sectional structure wherein a significant portion of the score residual associated with land 56 does not remain attached).

Once the main score 50 has completely severed the resulting aperture panel 54 and it is discarded, a user can drink directly from opening 58.

FIG. 8, described above, shows the relative height and configuration of countersink 22 and the center panel 30, and the relative positions of the main score 50 and the anti fracture score 52. The present invention is not limited to the particular embodiment of the end shown in FIG. 8. For example, FIGS. 10A, 10B, 10C, and 10D illustrate additional embodiments of end structures 14*a*, 14*b*, 14*c*, and 14*d* on which the present invention may be employed. To describe the embodiments shown in FIGS. 10A through 10D, reference numerals of the structure described above with respect to the first embodiment will be reused, but appended with a letter designation.

Each of ends 14*a*, 14, 14*c*, and 14*d* are seamed onto a can body 12*a*, 12*b*, 12*c*, 12*d*. FIGS. 10A, 10B, 10C, and 10D illustrate the cans having the aperture panel removed and ready for a user to drink from. The main scores, aperture panels, tabs, and all parts of the aperture panels for end embodiments 14*a*, 14*b*, 14*c*, and 14*d* are as described above for first embodiment can end 14.

Figure 10A:
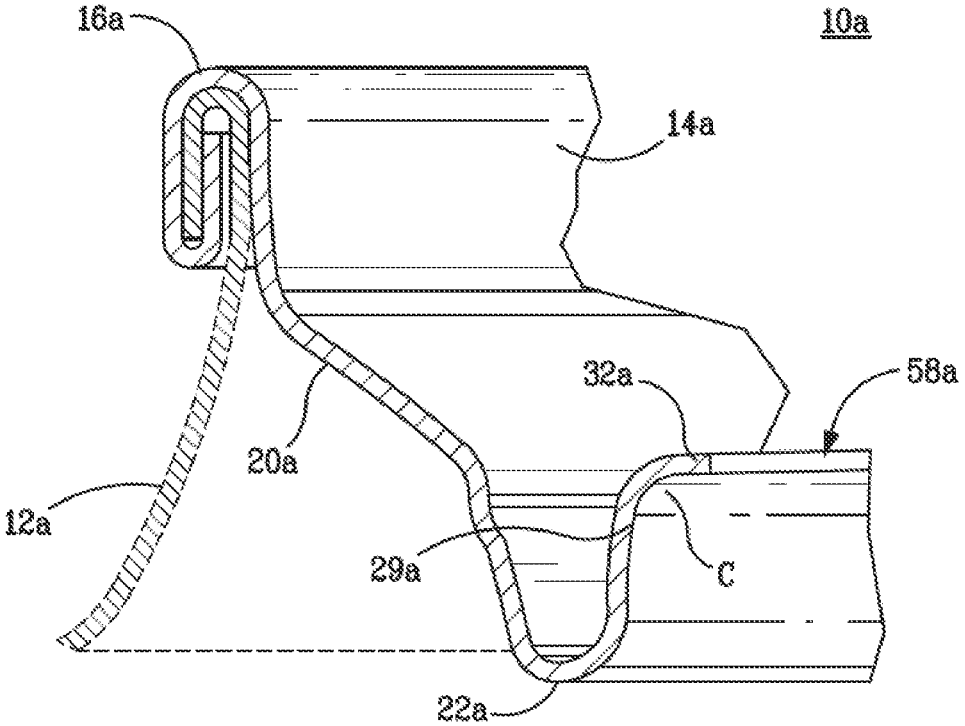
FIG. 10A is a cross section view of a can illustrating a can end with the removable aperture panel removed according to a second embodiment of the present invention.

End 14*a* of FIG. 10A is a variation of the SuperEnd® beverage can end described with respect to the first embodiment end 14. The location of the center C of the radius of transition wall 28*a* 50 is illustrated in FIG. 10A.

Figure 10B:
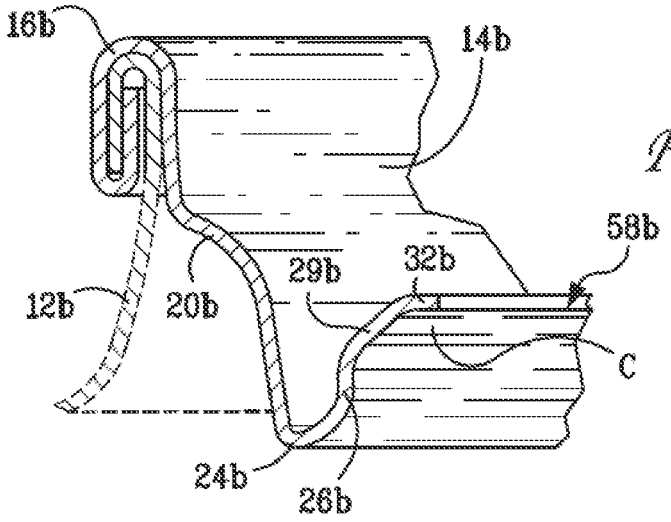
FIG. 10B is a cross section view of a can illustrating a can end with the removable aperture panel removed according to a third embodiment of the present invention.
Figure 10C:
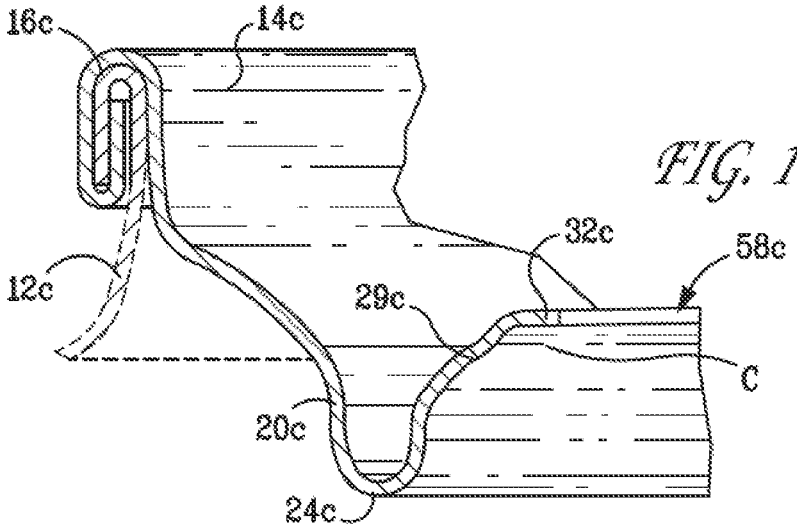
FIG. 10C is a cross section view of a can illustrating a can end with the removable aperture panel removed according to a fourth embodiment of the present invention.

End 14*b* of FIG. 10B is cross sectional view of an end supplied commercially by Container Development Limited. End 14*c* of FIG. 10C is a cross sectional view of an end referred to as LOF supplied by Metal Container Corporation. Each of ends 14*b* and 14*c* have an inner wall portion 29*b* and 29*c*, respectively, at the base of transition 28*b* and 28*c*. The present invention encompasses locating main score 50*b*, 50*c* radially outside of transition radius center C-b and C-d such that the main score is located within portions 29*b* or 29*c*.

Figure 10D:
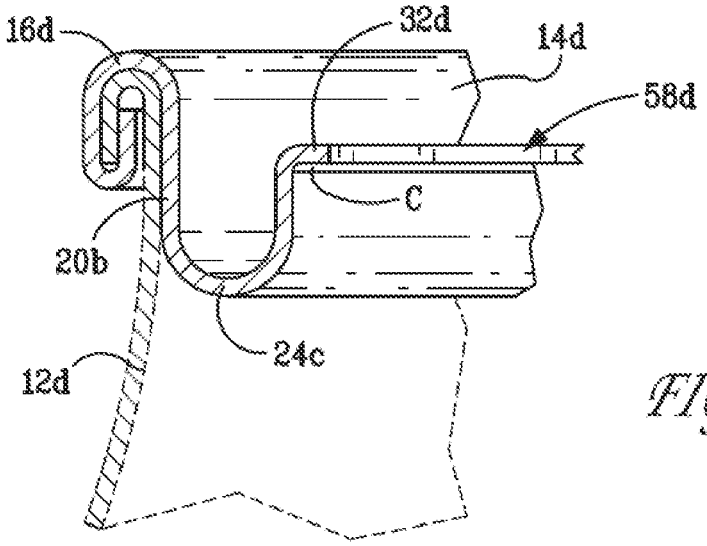
FIG. 10D is a cross section view of a can illustrating a can end with the removable aperture panel removed according to a fifth embodiment of the present invention

End 14*d* of FIG. 10D is a cross sectional schematic view of a conventional B64 end. The location of the center C of the radius of transition wall 28*d* is illustrated in FIG. 10D.

The present invention has been described with respect to particular embodiments, and it is understood that the present invention encompasses structure and function broader than the particular embodiments, even if labeled as preferred.

The invention claimed is:

1. A full aperture beverage end comprising:

a center panel, a countersink surrounding the center panel, a main score formed in the center panel and arranged in proximity to the countersink to define a removable aperture panel, a rivet, the rivet defining a rivet center, a tab affixed to the center panel by the rivet, the tab having a nose and a heel, the tab defining a primary reference line that extends from the nose to the heel and through the rivet center, the tab further defining a transverse reference line that is perpendicular to the primary reference line and extends through the rivet center, and a vent score formed in the center panel, the vent score including a pair of lateral portions that extend parallel to the transverse reference line and are disposed forward of the transverse reference line towards the nose of the tab by a first distance that is between 0 and 0.050 inches (0 mm and 1.3 mm), the vent score further including a pair of side portions that extend from the lateral portions, such that each side portion extends inwardly towards the primary reference line and rearwardly relative to the transverse reference line towards the heel of the tab by a second distance that is between 0.15 and 0.4 inches (3.8 and 10.2 mm) and such that the side portions are oriented at an angle relative to the primary reference line that is between −30 and +30 degrees, whereby the end is formed of 5000 series aluminum and adapted for use with products that are pressurized to over 70 psi and such that during opening the vent score is adapted to sever first, controlling the pressure differential between the external surface and internal surface of the center panel, thereby allowing the main score to tear in a controlled and reliable manner.

2. The full aperture beverage end according to claim 1 adapted for use with products held under pressure of between 70 and 90 psi.

3. The full aperture beverage end according to claim 1, wherein a heel of the tab is configured to be lifted by a user to initiate sequential rupture of the vent score and then the main score.

4. The full aperture beverage end according to claim 3, wherein the tab is solid and has no hinge.

5. The full aperture beverage end according to claim 3, wherein the tab is positioned so that a nose is within the main score or proximate to the main score upon initial actuation of the tab.

6. The full aperture beverage end according to claim 1, wherein the main score has an asymmetric score profile.

7. The full aperture beverage end according to claim 6, wherein the asymmetric score profile is designed to ensure that a score land portion of the asymmetric score profile remains with the aperture panel after the aperture panel is detached.

8. The full aperture beverage end according to claim 1, wherein the center panel further includes a second, anti-fracture score positioned radially inside the main score.

9. The full aperture beverage end according to claim 1, wherein the height from the base of the countersink to the end panel is greater than 0.060 inches (1.5 mm).

10. The full aperture beverage end of claim 1 wherein main score is positioned to within 0.020 inches (0.5 mm) radially of the panel fillet so as to maximize cut edge safety.

11. A full aperture beverage can rated for internal pressure of over 70 psi, the beverage can comprising:

a can body; and an end formed of 5000 series aluminum, seamed onto the can body, including a center panel and a main score and formed in the center panel, a rivet, the rivet defining a rivet center, and a tab affixed to the center panel by the rivet, the tab has a nose and a heel, the tab defining a primary reference line that extends from the nose to the heel and through the rivet center, the tab further defining a transverse reference line that is perpendicular to the primary reference line and extends through the rivet center, and a vent score formed in the center panel, the vent score including a pair of lateral portions that extend parallel to the transverse reference line and are disposed forward of the transverse reference line towards the nose of the tab by a first distance that is between 0 and 0.050 inches (0 mm and 1.3 mm), the vent score further including a pair of side portions that extend from the lateral portions, such that each side portion extends inwardly towards the primary reference line and rearwardly relative to the transverse reference line towards the heel of the tab by a second distance that is between 0.15 and 0.4 inches (3.8 and 10.2 mm) and such that the side portions are oriented at an angle relative to the primary reference line that is between −30 and +30 degrees.

12. The full aperture beverage can of claim 11 wherein the can is rated for internal pressure of at least 85 psi (586 kPa).

13. The full aperture beverage can of claim 11 wherein the can is rated for internal pressure of at least 90 psi (621 kPa).

14. The full aperture beverage can of claim 11, further including a countersink that surrounds the center panel, wherein a centerline of the main score is located between 0.000 inches and 0.020 inches (0.00 mm and 0.51 mm) from a center of a transition radius between the countersink and the center panel.

15. The full aperture beverage can of claim 11, further including a countersink that surrounds the center panel, wherein a centerline of the main score is located between 0.000 inches and 0.010 inches (0.00 mm and 0.25 mm) from a center of a transition radius between the countersink and the center panel.

16. The full aperture beverage can of claim 11, further including a countersink that surrounds the center panel, wherein a centerline of the main score is located between 0.000 inches and 0.006 (0.00 mm and 0.15 mm) inches from a center of a transition radius between the countersink and the center panel.

17. The full aperture beverage can of claim 11, further including a countersink that surrounds the center panel, wherein a centerline of the main score is located between 0.000 inches and 0.004 inches (0.00 mm and 0.10 mm) from a center of a transition radius between the countersink and the center panel.

18. The full aperture beverage can of claim 11, further including a countersink that surrounds the center panel, wherein a centerline of the main score is located between 0.000 inches and 0.002 inches (0.00 mm and 0.05 mm) from a center of a transition radius between the countersink and the center panel.

19. The full aperture beverage can of claim 11 wherein the nose of the tab in its rest state is radially inwardly spaced apart from an inner edge of the main score by between approximately 0.000 inches and 0.008 inches (0.00 mm and 0.20 mm), measured horizontally.

20. The full aperture beverage can of claim 11 wherein the nose of the tab in its rest state is radially inwardly spaced apart from an inner edge of the main score by between approximately 0.000 inches and 0.005 inches (0.00 mm and 0.13 mm), measured horizontally.

21. The full aperture beverage can of claim 11 wherein the nose of the tab in a partially actuated state, in which the tab nose contacts the center panel, is approximately between the centerline of the main score and 0.005 inches (0.13 mm) radially inboard from an inner edge of the main score.

22. The full aperture beverage can of claim 11 wherein the nose of the tab in a partially actuated state, in which the tab nose contacts the center panel, is within 0.002 inches (0.05 mm) of an inner edge of the main score.

* * * * *